United States Patent [19]

Yoshida et al.

[11] 4,098,243

[45] Jul. 4, 1978

[54] IGNITION TIMING CONTROL SYSTEM

[75] Inventors: Hiroshi Yoshida, Aichi; Kiyokazu Konishi, Kariya, both of Japan

[73] Assignee: Nippondenso Co., Ltd., Kariya, Japan

[21] Appl. No.: 733,406

[22] Filed: Oct. 18, 1976

[30] Foreign Application Priority Data

Oct. 30, 1975 [JP] Japan ..... 50-131022

[51] Int. Cl.[2] ..... F02P 1/00; F02P 5/04

[52] U.S. Cl. ..... 123/117 D; 123/117 R; 123/146.5 A; 123/148 E

[58] Field of Search ..... 123/148 E, 117 D, 117 R, 123/32 EB, 32 EC, 146.5 A

[56] References Cited

U.S. PATENT DOCUMENTS

| | | | |
|---|---|---|---|
| 3,738,339 | 6/1973 | Huntzinger et al. | 123/117 D |
| 3,904,856 | 9/1975 | Monpetit | 123/32 EB |
| 3,921,610 | 11/1975 | Hartig | 123/117 D |
| 3,942,491 | 3/1976 | Seite et al. | 123/117 D |
| 3,990,417 | 11/1976 | Tershak | 123/117 R |
| 3,998,193 | 12/1976 | Ives et al. | 123/117 D |
| 4,018,197 | 4/1977 | Salway | 123/117 D |

FOREIGN PATENT DOCUMENTS

| | | | |
|---|---|---|---|
| 2,252,026 | 11/1973 | France | 123/117 D |

*Primary Examiner*—Charles J. Myhre
*Assistant Examiner*—Parshofam S. Lall
*Attorney, Agent, or Firm*—Cushman, Darby & Cushman

[57] ABSTRACT

An ignition timing control system comprises a sensor for detecting a reference point of the crankshaft of an internal combustion engine in synchronism with the rotation of the crankshaft, a speed detector for detecting the rotational speed of the crankshaft, a processor responsive to an interruption request by the reference signal from the sensor for temporarily stopping the computational operation being executed at that time and computing a time period from the time of the interruption request to the point of ignition in accordance with a desired spark advance value and the speed signal from the speed detector to produce the corresponding computed value, and an ignition command circuit for applying an ignition command signal to the ignition system of the engine at the expiration of a time corresponding to the computed value from the processor.

15 Claims, 3 Drawing Figures

IGNITION TIMING CONTROL SYSTEM

BACKGROUND OF THE INVENTION

The present invention relates to an ignition timing control system which is capable of controlling as desired the ignition timing of an internal combustion engine by using a processor which executes computational operations in a software manner.

SUMMARY OF THE INVENTION

It is the object of the present invention to provide an ignition timing control system which is capable of controlling the ignition timing of an internal combustion engine by detecting a reference point of the engine crankshaft in synchronism with the rotation thereof as well as the rotational speed of the crankshaft, applying an interruption request to a processor in response to a reference signal indicative of the reference point to temporarily stop the computational operation being executed at that time, computing a time period from the time of the interruption request to the point of ignition in accordance with a desired spark advance value and the rotational speed of the crankshaft, and instructing the ignition system of the engine to spark at the expiration of a time period corresponding to the computed value of the processor, thus improving the computing efficiency of the processor.

DESCRIPTION OF THE PREFERRED EMBODIMENT

Figure 1:
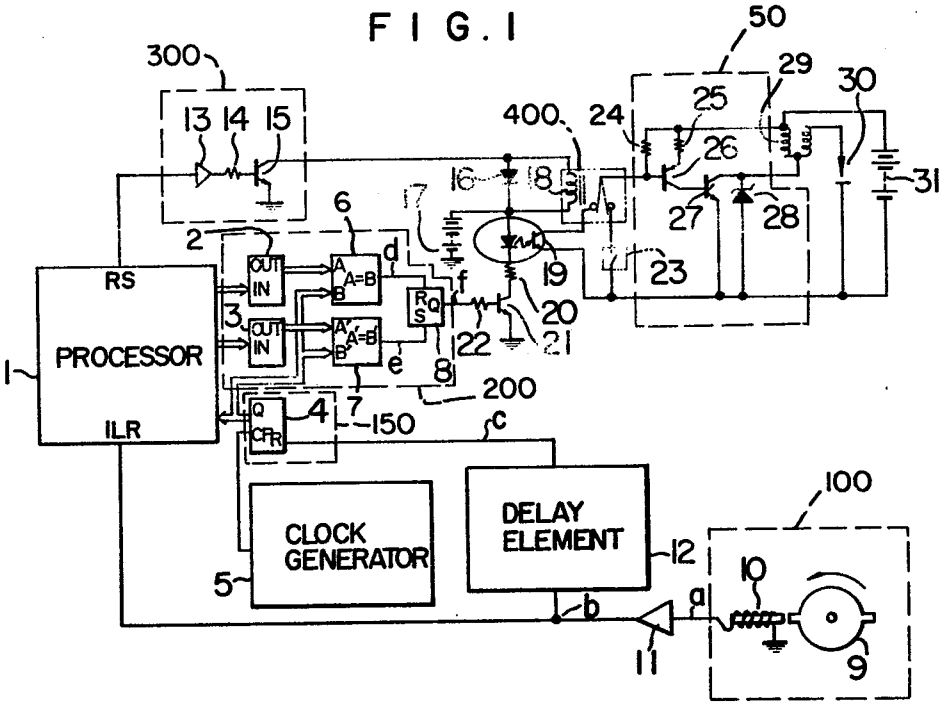
FIG. 1 is a wiring diagram showing an embodiment of an ignition timing control system according to the present invention.

The present invention will now be described in greater detail with reference to the illustrated embodiment. In FIG. 1 illustrating a wiring diagram showing the entire construction of the ignition timing control system according to the invention, numeral 1 designates a processor for performing computational operations in a software manner, namely, a processor in which the execution of various computational operations is accomplished in accordance with a predetermined control program and the required interruption computational operation for controlling the ignition timing is performed upon receipt of an interruption request. A suitable processor 1 is the TLCS-12 of Tokyo Shibaura Electric Co., Ltd. (Toshiba). The processor 1 includes a central processing unit (CPU), a read only memory (ROM) and a random access memory (RAM). A program for performing the computation sequence is stored in the ROM, and the processor 1 executes the computing sequence programmed in the ROM by temporarily storing or loading data in the RAM. When a predetermined input signal is delivered to an interrupt request terminal ILR of the processor 1, it interrupts the routine computation sequence and instead executes an interrupt computation sequence in accordance with another program stored in the ROM. The afore-mentioned function is common to most processors. For example, the processor, TLCS-12 in this embodiment may be replaced by the microprocessor MC6800 manufactured by MOTOROLA Semiconductor Products, Inc. in the U.S.A. and described in the "MC6800 Microcomputer System Reference Handbook" published in 1974. Numerals 2 and 3 designate first and second input/output (I/O) registers for temporarily storing the computed values of the processor 1 and each of these registers consists of the Toshiba T3220. If the above-mentioned microprocessor MC6800 is used as the processor 1, the peripheral Interface Adapters (PIA), MC68200 manufactured by MOTOROLA Semiconductor Products, Inc. can be used as the I/O registers. Numeral 4 designates a counter for counting clock pulses, 5 a clock generator for producing a 64 $KH_z$ clock pulse, 6 and 7 first and second digital comparators for respectively comparing the stored values of the I/O registers 2 and 3 with the count value of the counter 4 to produce a comparison signal when there exists the equality between the two values, 8 an R-S flip-flop which is reset by the comparison signal from the first digital comparator 6 and which is set by the comparison signal from the second digital comparator 7, thus producing an ignition command signal in response to the resetting thereof. Numeral 9 designates a disk mounted on the crankshaft of the engine with projections of a magnetic material provided at reference points of the crankshaft. Numeral 10 designates an electromagnetic pickup comprising a coil wound on a magnet so that a reference signal is produced when each of the projections on the disk 9 passes the pickup. Numeral 11 designates a rectifying amplifier for amplifying and rectifying the reference signal to produce a reference pulse. Numeral 12 designates a delay element for delaying the reference pulse to produce a delayed pulse which is used to reset the counter 1. Namely, the delay element 12 receives the reference pulse generated at the output of the rectifying amplifier 11 and generates an output pulse after a predetermined time $\tau$ at the reset terminal R of the counter 4. The reference pulse from the rectifying amplifier 11 is also used to request the processor 1 to produce an interrupt. Numeral 13 designates a noninverting buffer gate operable in response to the receipt of a low-level or "O" level (hereinafter referred to as "L-level") stop signal indicative of the stopping of the operation of the processor 1, 14 a base resistor, 15 an NPN transistor which is turned off in response to the stop signal and which is turned on during the time that the processor 1 is in operation. Numeral 16 designates a protective diode, 17 a controlling power source, 18 a relay for changing the connections in response to the turning on and off of the NPN transistor 15. Namely, the relay 18 holds an armature contact at a position as shown by a solid line, while the transistor 15 is turned on by a high-level or "1" level (hereinafter referred to as "H-level") generated at an RS terminal on the processor 1 in operation. While the transistor 15 is turned off by an L-level signal generated at the RS terminal of the processor 1 in a halt state, the relay 18 holds the armature contact at a position as shown by a dotted line. The noninverting buffer gate 13, the base resistor 14 and the transistor 15 constitute a detecting circuit 300 for detecting the operating state of the processor 1. A switching device 400 is constituted by the relay 18, and a switching means is constituted by the detecting circuit 300 and the switching device 400. Numeral 19 designates a photocoupler, 20 a current limiting resistor, 21 an NPN transistor which is turned off when the base current to a base resistor 22 is interrupted by the ignition command signal from the R-S flip-flop 8. Numeral 23 designates the cam contact in the distributor (not shown) which is mounted in the engine, 24 a bias resistor, 25 an emitter resistor, 26 a PNP transistor, 27 an NPN power transistor connected in phase with the PNP transistor 26. Numeral 28 designates a protective Zener diode, 29 an ignition coil in which the flow of current in the primary winding is interrupted in response to the turning off of the NPN power transistor 27 and a sparking high voltage is induced in the secondary winding. Numeral 30 designates a spark plug for igniting a mixture of fuel and air in the engine by means of the sparking high voltage, 31 an automobile power source. Transistors 26 and 27, and associated circuitry may thus be considered to be an ignition circuit, generally indicated as 50.

The disk 9 and the electromagnetic pickup 10 constitute a sensor 100 for detecting the reference points of the crankshaft in sychronism with the rotation of the crankshaft of the engine, the counter 4 constitutes speed detecting means 150 for detecting the rotational speed of the crankshaft, and the first and second I/O registers 2 and 3, the first and second digital comparators 6 and 7 and the R-S flip-flop 8 constitute ignition command means 200 for producing an ignition command signal at the expiration of a time period corresponding to the computed value of the processor 1.

Figure 2:
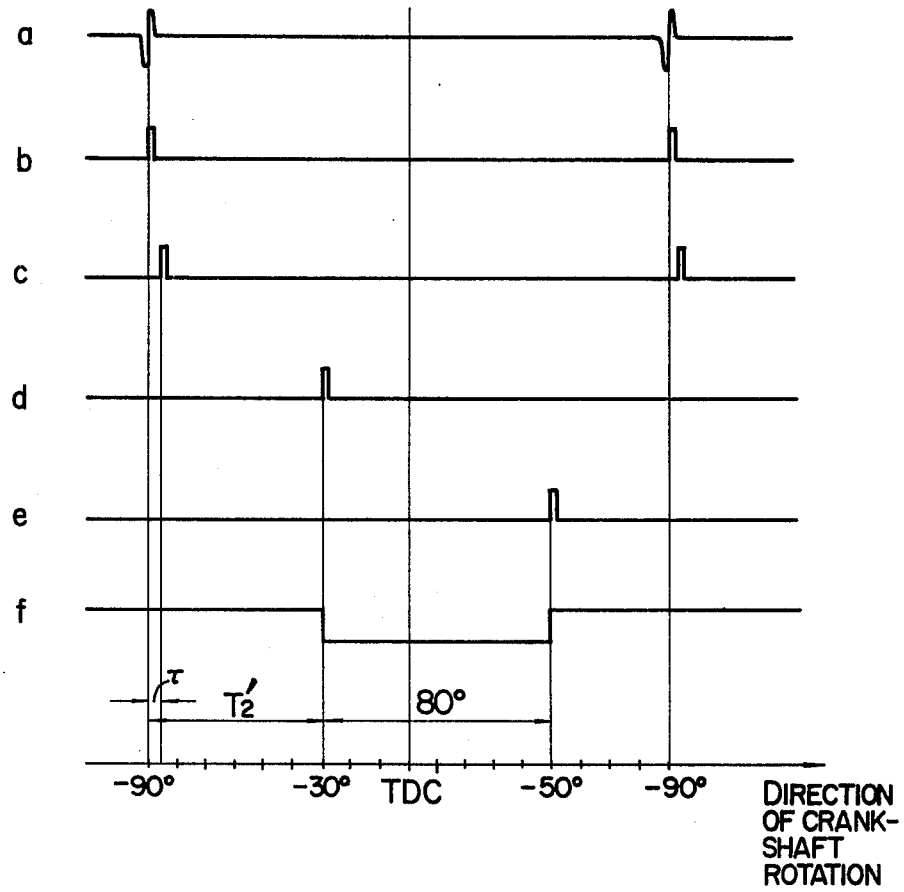
FIG. 2 is a voltage waveform diagram which is useful for explaining the operation of the system according to the invention.
Figure 3:
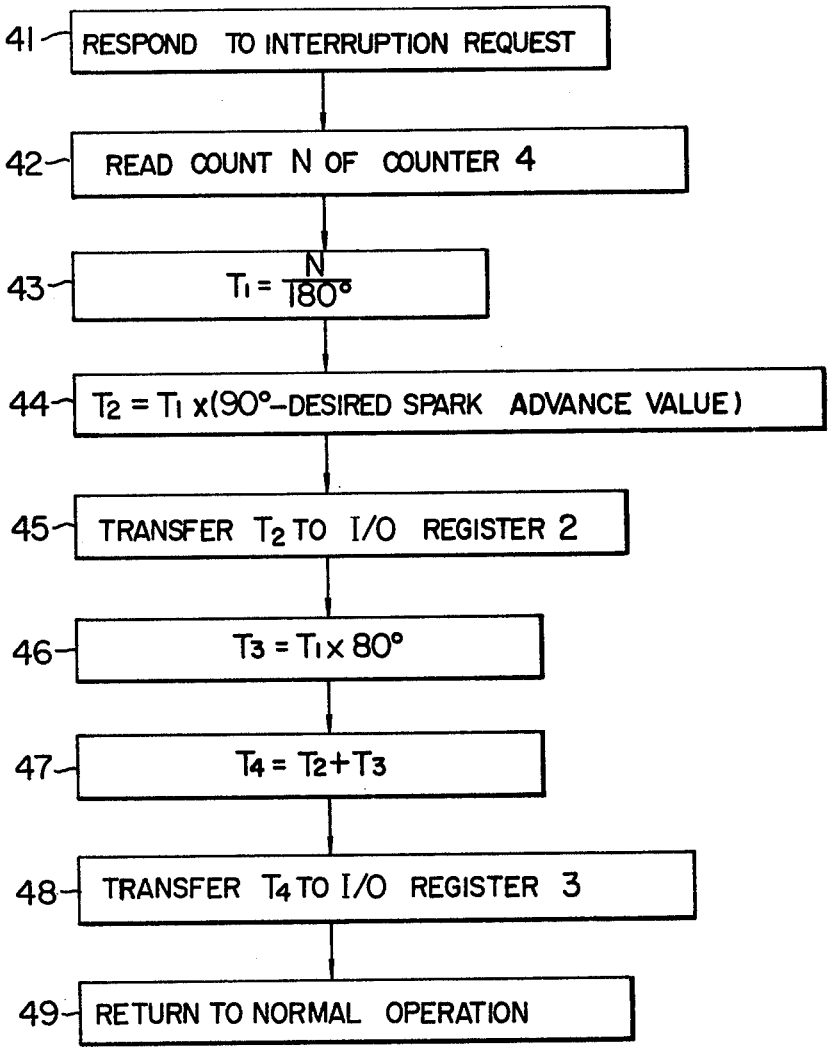
FIG. 3 is a flow chart which is useful for explaining the operation of the processor shown in FIG. 1.

Next, the operation of the ignition timing control system constructed as described above will be described with reference to the signal waveform diagram of FIG. 2 and the flow chart of FIG. 3. The disk 9 mounted on the engine crankshaft is formed with the two projections which are displaced from each other by 180° of the crankshaft rotation and the electromagnetic pickup 10 is mounted at a reference point of the crankshaft corresponding to 90° before the top dead center of the piston so that its output reference signal *a* has the waveform shown at *a* of FIG. 2. This output reference signal *a* is rectified by the rectifying amplifier 11 and the resulting reference pulse *b* has the waveform shown at *b* of FIG. 2. The reference pulse *b* is applied to the delay element 12 which produces the delayed pulse *c* shown at *c* of FIG. 2. This delayed pulse *c* is applied to the reset input of the counter 4 which in turn repeatedly produces at its output Q the count of the clock pulses produced from the clock generator 5 for every 180° of the crankshaft rotation. Preferably, the counter 4 is a binary counter. The binary output thereof represents a value inversely proportional to the rotational speed of the engine and is applied, as a detected value of the crank shaft rotational speed, to the processor 1. On the other hand, the output reference pulse *b* of the rectifying amplifier 11 is applied to the interrupt request terminal (ILR) of the processor 1 so that at every point of 90° before the top dead center the processor 1 is requested the produce an interruption and compute the desired point of ignition. The flow chart of this series of operations is shown in FIG. 3. The computation sequence of the flow chart shown in FIG. 3 is written in an interruption program format to be executed by the processor 1 in response to the interruption request, and the interruption program is stored in the ROM of the processor 1, together with a program for other routine computation sequences. In the discussion to follow, the desired spark advance value indicates a spark advance angle before the top dead center and the angle is 30° in the illustrated embodiment. A computed value $T_2$ represents the number of clock pulses produced during a time period $T_2'$ from 90° before the top dead center to the point of ignition. The angle of 80° represents an angle during which the flow of current in the ignition coil 29 is stopped. Thus, similarly a computed value $T_4$ represents the number of clock pulses produced during a time period from 90° before the top dead center to the point at which the flow of current in the ignition coil 29 is restarted.

Initially, the execution of a computational operation is started at a first step 41 responding to the interruption request by the reference pulse *b*, and a count value N of the counter 4 which indicates a value inversely proportional to the rotational speed of the crankshaft is read at a second step 42. The control is then transferred to a third step 43 at which a change $T_1$ in the clock count value for every 1 degree of crankshaft rotation is obtained by performing a division $T_1 = N/180°$ and the control is further transferred to a fourth step 44 at which the number of clock pulses $T_2$ produced during a time period between the reference point and the ignition point is obtained by performing a multiplication $T_2 = T_1 \times (90° - \text{the desired spark advance value})$. The result of this multiplication or the clock count value $T_2$ is transferred to and temporarily stored in the first I/O register 2 at a step 45. Then, at a sixth step 46, the number of clock pulses $T_3$ produced during 80° of crankshaft rotation from the point of ignition is obtained by performing a multiplication $T_3 = T_1 \times 80°$, and then at the next step 47 the number of clock pulses $T_4$ produced during a time period from the reference point to the next waiting period after the ignition is obtained by performing an addition $T_4 = T_2 + T_3$ the result of which or the number of clock pulses $T_4$ is in turn transferred to and stored temporarily in the second I/O register 3 at an eighth step 48. Thereafter, at a ninth step 49 the execution of the computational operation started in response to the interruption request by the reference pulse *b* is completed and the control is returned to the normal operation.

The outputs of the first and second I/O registers 2 and 3 or the computed values stored during the above-mentioned interrupt computational operation are applied respectively to one input terminals of the first and second digital comparators 6 and 7 and the output Q of the counter 4 is applied to the other input terminals of these comparators. Consequently, when the output Q of the counter 4 coincides with the output of the first I/O register 2, that is, at 30 degrees before the top dead center, the comparison signal *d* shown at *d* of FIG. 2 is produced at the A = B terminal of the first digital comparator 6. Similarly, the comparison pulse *e* shown at *e* of FIG. 2 is produced at the A = B terminal of the second digital comparator 7 at 50° after the top dead center. These comparison pulses *d* and *e* are respectively applied to the reset terminal R and the set terminal S of the R-S flip-flop 8 which in turn produces at its output the ignition command signal *f* shown at *f* of FIG. 2. This ignition command signal *f* is then amplified by the transistor 21 and the signal is supplied to the electrically isolated ignition system through the photocoupler 10. Namely, while the output signal of the R-S flip-flop 8 is at H-level of "1" level, the transistor 21 and thus the photocoupler 19 are turned on. Both the transistors 26 and 27 are turned on to energize the ignition coil 29 since the armature contact of the relay 18 is held at the position shown in the solid line during the operation of the processor 1 as described earlier. When the output signal of the R-S flip-flop 8 is inverted from H-level or "1" level to L-level or "0" level, the transistor 21 and thus the photocoupler 19 are turned off so that both the transistors 26 and 27 are cut off to de-energize the ignition coil 29. At the time the ignition coil 29 is de-energized, a high tension is applied to the ignition plug 30.

When the processor 1 stops its operation, an L-level signal is produced at its RS terminal so that the transistor 15 is turned off and the contact of the relay 18 is automatically connected to the cam contact 23 in the distributor thus continuing the sparking. Namely, when the processor 1 is in the halt state, the R-S flip-flop 8 does not generate an output signal to thereby cause both the transistor 21 and the photocoupler 19 to be turned off.

Thus, the ignition coil 29 is kept de-energized and the high tension cannot be applied to the ignition plug 30. In such a case, in order to generate the high tension across the ignition coil 29, the armature contact of the relay 18 is changed to the position shown by the dotted line so that the transistors 26 and 27 may be turned on and off by a contact cam 23 rotated by the engine in a conventional manner.

While, in the above-described embodiment of the invention, two units of the I/O register and digital comparator combination, i.e., the I/O registers 2 and 3 and the digital comparators 6 and 7 are employed, one of the two units may be elimimated to make the remaining one unit of the I/O register and digital comparator combination to serve the double purpose, in which case it is only necessary to alter the software of the processor 1 so that the results of the operation performed during a time period from the reference point to the point of ignition are stored in the I/O register to control the production of an ignition command signal and the results of the operation from the ignition to the restoration to the waiting condition is stored in the same I/O register by presetting to control the restoration to the waiting condition.

Further, while, in the above-described embodiment, the speed detecting means produces a count value which is inversely proportional to the rotational speed of the crankshaft, any other means such as one which produces a detected value proportional to therotational speed of the crankshaft may also be used.

Still further, while, in the above-described embodiment, the reference point sensor produces a reference signal each time the crankshaft rotates 180°, it is possible to use any other sensor which produces a reference signal for every 360° of crankshaft rotation and the reference point may also be present as desired.

We claim:

1. In an ignition timing control system for use with an internal combustion engine, said engine having associated therewith a processor for sequentially executing a plurality of control functions including said ignition timing control, said ignition timing control system being of the type including means for generating a signal indicative of the rotational position of the engine camshaft and means for developing from said position signal a speed signal indicative of the rotational speed of said camshaft, said speed signal being applied as an input signal to said processor; the improvement wherein:

said processor includes interrupt means, responsive to said positional signal, for effecting an interruption of the normal operational sequence of said processor and initiating on a priority basis, execution of said ignition timing control function.

2. An ignition timing control system for use in combination with an internal combustion engine having a crankshaft and an ignition system comprising:

a sensor disposed to detect a reference point of said crankshaft for providing reference pulses in synchronism with the rotation of said crankshaft;

speed detecting means responsive to said reference pulses, for generating a speed signal having a predetermined relation to the rotational speed of said crankshaft;

a processor receptive of said speed signal and having an interruption request input terminal and data terminals, said reference pulses being applied to said interrupt request terminal as interruption requests; and said processor including means for, responsive to said interruption requests, interrupting a computational operation being executed at that time, computing a time period from the time of the production of said reference pulse to a point of ignition corresponding to a spark advance value in accordance with said speed signal and producing at said data terminals a signal indicative of computed value of said time period; and ignition command means responsive to said computed time period signal, for applying to said ignition system an ignition command signal for initiating sparking at the expiration of said computed time period after the production of said reference pulse.

3. A system according to claim 1 adapted for use with a further ignition timing control means, further comprising:

switching means connected to said processor and for, in response to a halt operation of said processor, preventing the ignition command signal from said ignition command means for being applied to said ignition system and selectively coupling said further ignition timing control means to said ignition system.

4. A system according to claim 3 wherein said switching means includes:

a detecting circuit for generating an output signal indicative of the halt in operation of said processor; and a switching device connected to said detecting circuit responsive to said detecting circuit output signal changing connections to said ignition system.

5. A system according to claim 1, further comprising restoring means for changing the state of said ignition command means at the expiration of a restoring interval from the time of the production of said reference pulse to a command releasing point after said ignition point and thereby restoring said ignition command means to a waiting condition for the next ignition command.

6. A system according to claim 1, wherein said speed detecting means includes a counter resettable in response to the reference pulse from said sensor to count clock pulses having a predetermined frequency.

7. An ignition timing control system for use in combination with an internal combustion engine having a crankshaft and an ignition system comprising:

a sensor disposed to detect a reference point of said crankshaft for roducing reference pulses iin synchronism with the rotation of said crank shaft;

a counter, connected to said sensor and resettable in response to said reference pulses, for counting clock pulses having a predetermined frequency;

a processor having an interruption request input terminal, and data input and output terminals, said reference pulses being applied to said interruption request input terminal as an interruption request, and said counter being coupled to said data signal input terminal, said processor including means for, responsive to said interruption request, interrupting a computational operation being executed at that time, receiving, at said data input terminals a count value of said counter immediately before the resetting thereof to derive a change in said count value corresponding to a unit rotational angle of said crankshaft, and producing, at said data output terminals, a computed value indicative of the number of clock pulses corresponding to a time period from the time of said interruption request to a point of ignition corresponding to a spark advance value;

a register connected to the data output terminals of said processor for storing said computed value;

a comparator connected to said register and said counter for producing a comparison signal when the count value of said counter reaches the stored value of said register; and command means, connected to said comparator and responsive to the comparison signal therefrom, for supplying to said ignition system of said engine a command signal for initiating sparking.

8. A system according to claim 7 adapted for use with an auxiliary distributor which provides ignition command signals in accordance with the actuation of a contact cam, further comprising:

switching means, connected to said processor, for, responsive to a halt in operation of said processor, for preventing the command signal from said command means from being applied to said ignition system and to selectively apply to said ignition system ignition command signals from said distributor.

9. A system according to claim 8, wherein said switching means includes:

a detecting circuit for generating an output signal indicative of the halt in operation of said processor; and a switching device connected to said detecting circuit and responsive to said detecting circuit output signal, for changing connections to said ignition system.

10. A system according to claim 7, further comprising restoring means for computing a restoring interval from the time of said interruption request to a command releasing point after said ignition point and thereby changing the state of said command means at the expiration of said restoring interval after the production of said reference pulse to restore said command means to a waiting condition for the next ignition command.

11. A system according to claim 7, further comprising delay means for delaying said reference pulse, said delay means being connected between said sensor and said counter.

12. A system according to claim 7 wherein said data input and output terminals are in common.

13. An ignition timing control system for use in combination with an internal combustion engine comprising:

a disc having at least one projection of a magnetic material, said disc rotating corresponding to rotational speeds of a crankshaft of the engine;

an electromagnetic pickup coupled to said disc, said pickup producing a reference signal each time the projection of said disc passes therethrough;

a clock generator for generating clock pulses for a predetermined frequency;

a counter connected to said electromagnetic pickup and said clock generator for counting said clock pulses, said counter being reset in response to the reference signal;

a processor having an interruption request input terminal and data input and output terminals, being coupled to said interruption request terminal such that said reference signal is applied to said processor as an interruption request and said counter being coupled to said data input terminal, said processor including means, responsive to said interruption request for interrupting a computation operation being executed at that time, receiving, at said data input terminals, a counted value of said counter immediately before the resetting thereof to determine the number of clock counts per unit rotational angle of said crankshaft, and producing, at said data output terminals, first and second computed count values, said first computed count value being produced by a multiplification of said number of clock counts per unit rotational angle and a first rotational angle from a point of the interruption request to a point of ignition in accordance with a desired spark advance value, said second computed count value being produced by a multiplication of the number of clock pulses per unit rotational angle and a second rotational angle from the point of the interruption request to a point corresponding to a leading edge of a dwell angle of said engine;

a first register connected to the data output terminals of said processor for storing said first computed count value;

a second register connected to the data output terminals of said processor for storing said second computed count value;

a first comparator connected to said first register and said clock generator for producing a first comparison signal when the number of the clock pulses from said clock generator coincides to said first computed count value;

a second comparator connected to said second register and said clock genertor for producing a second comparison signal when the number of the clock pulses from said clock generator coincides to said second computed count value;

a flip-flop connected to said first and second comparators for producing a first command signal in response to said first comparison signal and a second command signal in response to said second comparison signal; and ingition means connected to said flip-flop for initiating sparking in response to said first command signal, and initiating dwell time operation in response to said second command signal.

14. A system according to claim 13 adapted for use with an auxiliary distributor which produces sparking command signals in accordance with the actuation of a contact cam and further comprising:

switching means, connected to said processor, said flip-flop and said ignition means, for, responsive to a halt in said processor operation preventing said first and second command signals from being applied to said ignition means and to selectively apply to said ignition means sparking command signals from said distributor.

15. A system according to claim 13 wherein said data input and output terminals are in common.

* * * * *